US008306441B2

(12) United States Patent
Morris et al.

(10) Patent No.: US 8,306,441 B2
(45) Date of Patent: Nov. 6, 2012

(54) PRINTING SYSTEM AND METHOD FOR HANDLING UNFIXED PAGES IN SUCH A PRINTING SYSTEM

(75) Inventors: Edward Morris, Buchbach (DE); Richard Schweikl, Munich (DE); Ulrich Bardolatzy, Poing (DE); Johann Bartosch, Taufkirchen (DE)

(73) Assignee: Océ Printing Systems GmbH, Poing (DE)

( * ) Notice: Subject to any disclaimer, the term of this patent is extended or adjusted under 35 U.S.C. 154(b) by 409 days.

(21) Appl. No.: 12/695,912

(22) Filed: Jan. 28, 2010

(65) Prior Publication Data

US 2010/0196020 A1 Aug. 5, 2010

(30) Foreign Application Priority Data

Jan. 30, 2009 (DE) ..... 10 2009 006 809

(51) Int. Cl.
*G03G 15/00* (2006.01)
*G03G 15/20* (2006.01)

(52) U.S. Cl. ..... 399/19; 399/18; 399/20; 399/33; 399/67; 399/68; 399/384

(58) Field of Classification Search ..... 399/18, 399/19, 20, 21, 33, 384
See application file for complete search history.

(56) References Cited

U.S. PATENT DOCUMENTS

| | | | | |
|---|---|---|---|---|
| 4,954,848 | A * | 9/1990 | Arima | 399/19 |
| 5,023,631 | A | 6/1991 | Negishi et al. | |
| 5,148,284 | A | 9/1992 | Nishikawa et al. | |
| 5,532,811 | A * | 7/1996 | Nishikawa et al. | 399/384 |
| 6,256,474 | B1 | 7/2001 | Gibisch et al. | |
| 6,567,621 | B2 | 5/2003 | Miyoshi et al. | |
| 6,666,594 | B2 | 12/2003 | Parry | |
| 6,724,494 | B1 | 4/2004 | Danknick | |
| 2004/0139115 | A1 | 7/2004 | Schmidt et al. | |
| 2005/0024411 | A1 | 2/2005 | Takenouchi et al. | |
| 2006/0147232 | A1 * | 7/2006 | Fuchs et al. | 399/384 |
| 2006/0153613 | A1 | 7/2006 | Nemmaier et al. | |
| 2007/0014580 | A1 * | 1/2007 | Woo | 399/21 |

FOREIGN PATENT DOCUMENTS

| | | |
|---|---|---|
| DE | 39 37 835 | 6/1990 |
| DE | 40 35 732 | 5/1991 |
| DE | 10 2004 026 217 | 12/2004 |

* cited by examiner

*Primary Examiner* — Judy Nguyen
*Assistant Examiner* — Justin Olamit
(74) *Attorney, Agent, or Firm* — Schiff Hardin LLP

(57) ABSTRACT

A recording medium is moved to a transfer printing station and print images are transfer-printed. The recording medium is transported to a fixing station. A print stop is initiated whereby the recording medium is halted, a further transfer printing is prevented, and a fixing is deactivated. It is checked whether a transfer-printed but unfixed page is still located in the printing apparatus. If so, a warning notification is automatically generated. A query is made as to whether an operating command has been input. If so, it is checked whether the unfixed page would also be output unfixed. If no, the operating command is executed. If yes, the print stop is automatically maintained. It is also inspected as to whether the unfixed page would be output upon execution of an additional operating command. If no, the additional operating command is executed. If yes, an error message is automatically generated.

14 Claims, 5 Drawing Sheets

PRINTING SYSTEM AND METHOD FOR HANDLING UNFIXED PAGES IN SUCH A PRINTING SYSTEM

BACKGROUND

The preferred embodiment concerns a printing system and a method for handling unfused pages in such a printing system.

The preferred embodiment in particular concerns an electrographic printing system in which images are applied on a recording medium by means of toner via an electrophotographic method, for example, and subsequently are fused on the recording medium with a fusing method (for example by means of radiant heat).

The preferred embodiment furthermore in particular concerns a printing system in which band-shaped recording media are printed in which, for example, paper webs that are wound on rolls are supplied to the printing system. Such systems are typically used in high capacity digital printing systems that print individual pages with print speeds of a few tens to a few thousands of DIN A4 pages per minute.

At such high speeds, problems sometimes occur when the running print operation is halted manually by an operator or is stopped automatically due to an internal system problem. In particular, given the execution of very large print jobs that, for example, comprise multiple hundreds of thousands or over a million pages, the problem can occur that page information is lost in the course of a printing stop, or already-printed pages or page portions are damaged such that they are no longer suitable to be issued. This problem can in particular occur given damages to the paper web. In such cases, a known possibility for error correction is to advance the paper web by a greater length so that all already-printed pages are issued and the printing process is then restarted. However, what is disadvantageous in this method is that the paper quantity that is advanced in this way is unprinted, and the corresponding paper quantity is to be discarded as spoilage.

Spoilage is also generated in many cases when it is required in the course of changing the printing apparatus over from a first print job to a second print job to vary certain apparatus parameters (for example a set page length), in particular when the transport of the recording medium is monitored inside the machine per page with sensors.

An electrographic printing system is known from US 2006/0147232 A1. An electrographic printing system in which recurring markers on a recording medium are scanned and detected is known from U.S. Pat. No. 6,256,474 B1.

Methods and devices with which error states in the operation of printing or copying apparatuses can be dealt with are known from U.S. Pat. No. 6,666,594 B2 and US 2006/0153613 A1.

A printing system in which the execution of print jobs is tracked specific to the document and, in the case of an output error, a targeted reprinting of documents occurs is known from US 2004/0139115 A1.

The aforementioned documents are herewith incorporated by reference into the present Specification.

As already mentioned above, upon termination of a printing process in which printing occurs on web-shaped recording material the problem sometimes exists that spoilage is generated. In printing systems in which the print image is applied on the recording material in a transfer printing station such that the print image is not yet permanently adhered to the recording medium (consequently is not yet fused), is subsequently to be transported over a certain transport distance and only then arrives at a fixing station within which the print image is fused on the recording material, unwanted large quantities of spoilage can be generated in the cited cases because the transport distance between the transfer printing station and the point at which the fused image leaves the printing apparatus is relatively long and, for example, can amount to multiple meters. For this reason it is desirable to initially leave printed, but not fused, pages in the printing apparatus in the course of a printing stop or a change of print jobs and apparatus change-over's connected with these. On the other hand, however, in many cases it is necessary to move the paper web at least partially in the course of such change-over's in order to be able to make necessary adjustments, for example the sensitization of sensors for the synchronization of the paper transport.

Since, in the course of apparatus stops or change-over measures, diverse apparatus groups are placed in separate operating states or are even deactivated, the danger exists that pages that have already been printed ultimately are not fused, meaning that they leave the printing apparatus unfused and therefore are unusable. In later processing steps this can even lead to contamination or disruptions in other apparatuses because the unfused dye (for example toner) unintentionally detaches from the recording medium.

If such unfused pages are output, it is additionally disadvantageous that the page ultimately loses its information, i.e. is unusable. In particular given a processing of documents that is automatic to the greatest possible extent, for example given the automatic generation of invoices in computers and their printing up to the point of mailing to the invoice recipients, this can undesirably have the result that unfused pages are delivered and the printed information does not reach the recipient.

SUMMARY

It is an object to provide a printing system in which print images are initially transfer-printed on a recording medium, the recording medium is then transported to a fixing station and there the print image is fused on the recording medium, as well as a method for such a printing system in which it is avoided that unfused pages are output from the printing system without monitoring.

Furthermore, it is an alternative object to optimally ensure that all pages of the job ultimately exist in a fused, correctly printed quality given the execution of print jobs in such a printing apparatus.

In a method or system to print a recording medium in a printing system, the recording medium is moved to a transfer printing station and there print images corresponding to the print data are transferred-printed per page onto the recording medium. The recording medium is transported from the transfer printing station to a fusing station. A print stop is initiated whereby the recording medium is halted, a further transfer printing is prevented, and a fixing is deactivated. It is automatically checked whether at least one transfer-printed but unfused page is still located in the printing apparatus. If so, a warning notification is automatically generated and displayed on a display device. Also a query is made as to whether an operating command has been input. If so, in a first check it is checked whether the at least one unfused page would also be output unfused upon execution of the operating command. If the first test yields a no, the operating command is executed. If the first check yields a yes, the print stop is automatically maintained and a query is executed as to whether an additional operating command has been input. In the second check it is also inspected as to whether the at least one unfused page would be output unfused upon execution of the additional operating command. If the second check yields a no, the additional operating command is executed. If the second check yields a yes, an error message is automatically generated that indicates the at least one unfused page is to be reprinted.

DESCRIPTION OF THE PREFERRED EMBODIMENT

Figure 1:
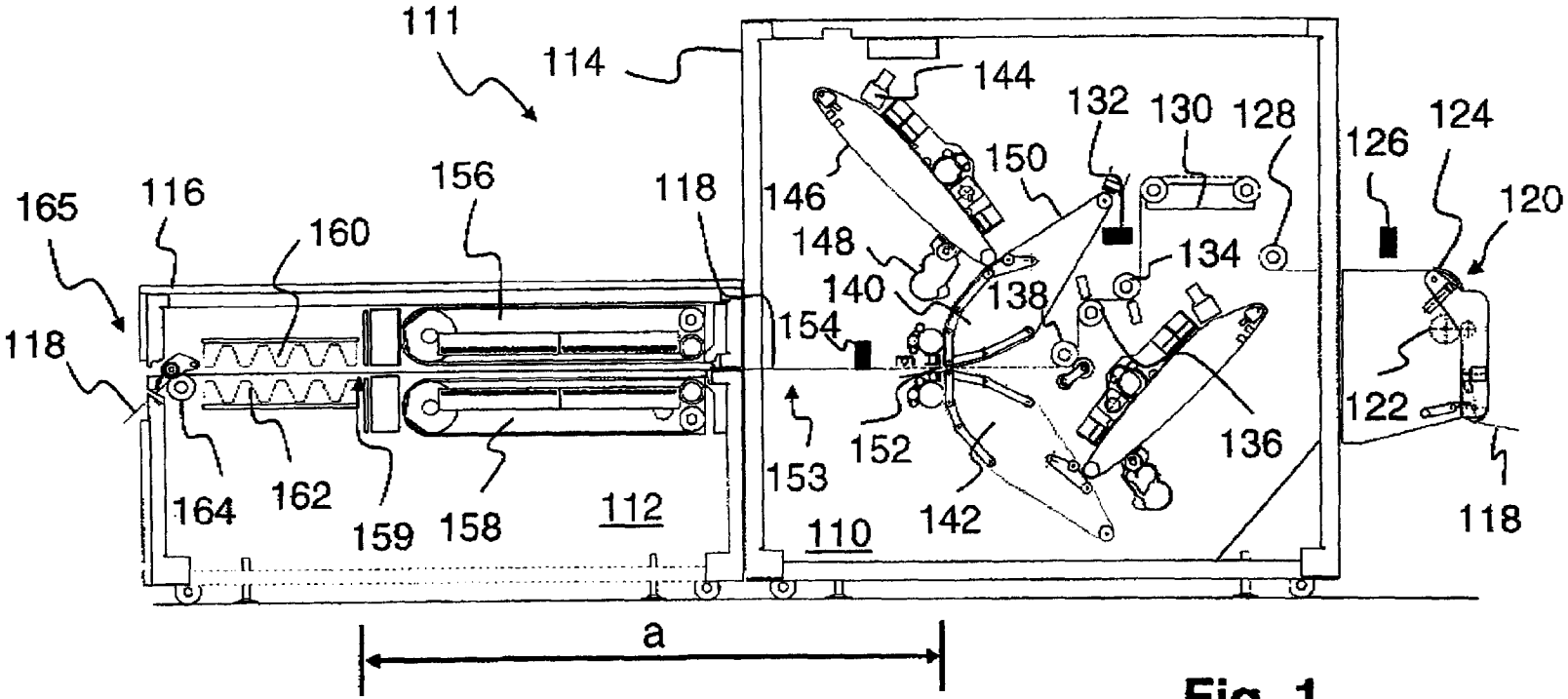
FIG. 1 is an electrophotographic printing apparatus.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated devices and such further applications of the principles of the invention as illustrated as would normally occur to one skilled in the art to which the invention relates are included.

Figure 5:
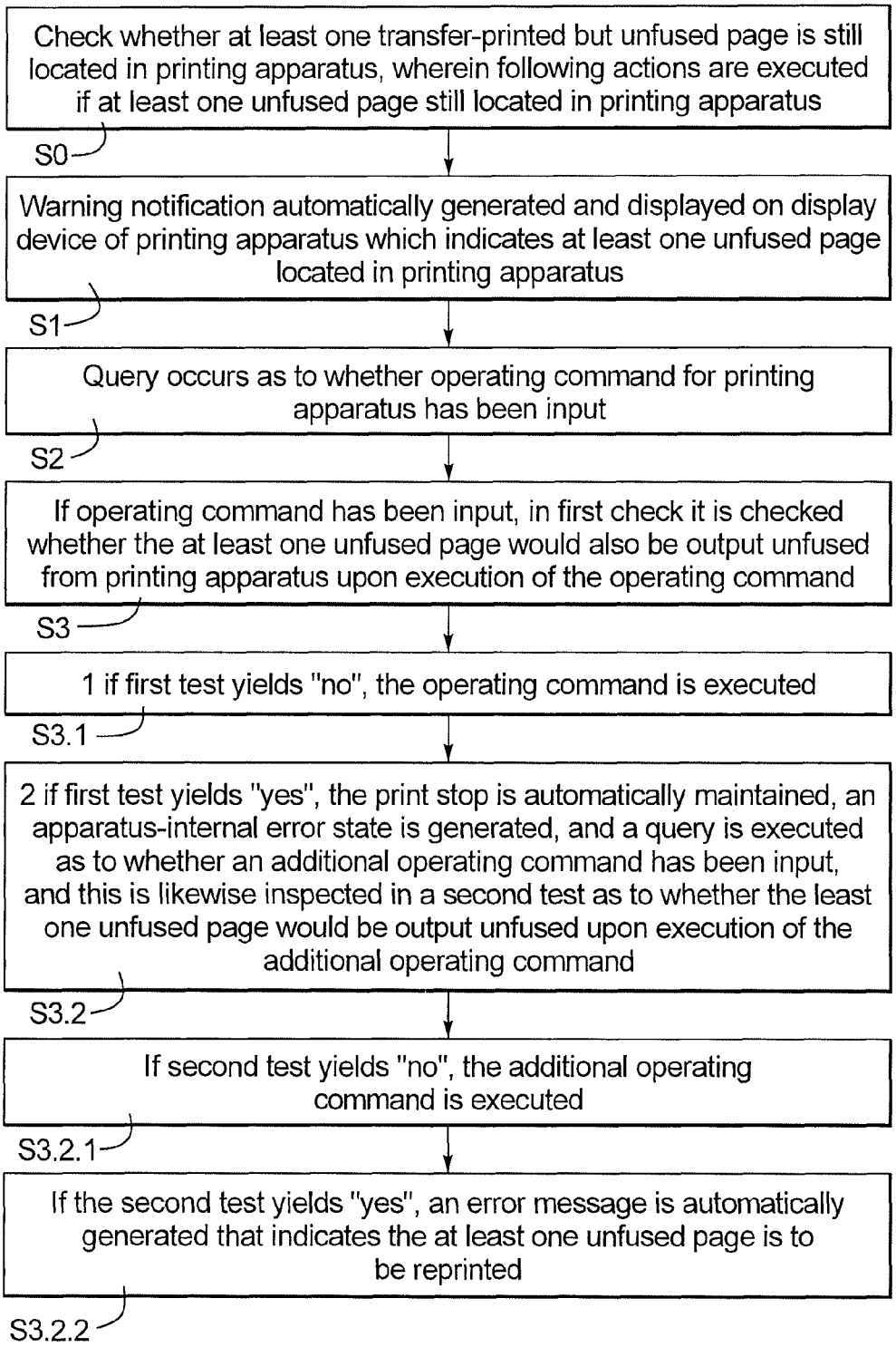
FIG. 5 illustrates a flow chart for method steps of the preferred embodiment.

According to the preferred embodiment, a web-shaped recording medium is printed in a digital high capacity printing system that comprises at least one digital data source and a printing apparatus connected to the digital data source. Print data of a print job are thereby transferred from the data source to the printing apparatus, the recording medium moves to a transfer printing point of a transfer printing station of the printing apparatus, and there print images corresponding to the print data are transfer-printed per page onto the recording medium. The recording medium is transported over a transport area from the transfer printing point to a fusing station of the printing apparatus in which the print images are respectively subjected to a fusing process to be fused on the recording medium. A print stop is initiated at the printing apparatus. This can in particular be initiated by means of a stop operation function or automatically due to an error message internal to the apparatuses. Due to the print stop the recording medium is halted, a further transfer printing is prevented and the fusing station is deactivated. Furthermore it is automatically checked as shown at S0 in FIG. 5 whether at least one transfer-printed but unfused page is still located in the printing apparatus, wherein the following actions are executed in the printing apparatus as shown in FIG. 5 if at least one unfused page is still located in the printing apparatus:

- S1: A warning notification is automatically generated and displayed on a display device of the printing apparatus, which warning notification indicates that at least one unfused page is located in the printing apparatus.
- S2: A query occurs as to whether an operating command for the printing apparatus has been input.
- S3: In the event that an operating command has been input, in a first check it is thereupon checked whether the at least one unfused page would also be output unfused from the printing apparatus upon the execution of the operating command, and
- S3.1: if the first test yields "no", the operating command is executed,
- S3.2: if the first test yields "yes", the print stop is automatically maintained, an apparatus-internal error state is generated and a query is executed as to whether an additional operating command for the printing apparatus has been input, and this is likewise inspected in a second test as to whether the at least one unfused page would be output unfused from the printing apparatus upon execution of the additional operating command,
- S3.2.1: if the second test yields "no", the additional operating command is executed and
- S3.2.2: if the second test yields "yes", an error message is automatically generated that indicates that the at least one unfused page is to be reprinted.

With the described method, the handling of unfused pages in the printing apparatus after a print stop is safely designed such that these can only leave the printing apparatus in the unfused state if it is simultaneously ensured that a reprinting of the unfused pages can be initiated. The reliability of the printing system with regard to the complete printout of all pages of a print job (what is known as data integrity) can thereby be achieved.

In the course of the apparatus-internal error state generated after the first test, the warning notification can in particular be displayed on the display device and another or an additional notification can be displayed and/or output.

The error message generated after the second test can in particular contain information for the identification of the at least one unfused page. Using the information, the page can be identified within print data that contain data from a plurality of pages, for example in the external data source or also in a memory internal to the printing apparatus. A reprinting can then be further controlled from there. The memory can in particular be integrated into a controller that caches data of a print job in a print data language and/or per page in rastered form.

Furthermore, a multi-stage method for handling the unfused pages at the printing apparatus is provided with the preferred embodiment First only a warning notification is output at the display device so that an operator has the possibility to input operating commands at the printing apparatus via which it is ensured that the unfused pages are still subsequently fused. In the event that this message is ignored or unsuitable operating commands are input, the print stop is maintained and an apparatus-internal error state is generated. Additional information or warnings that the measures that the operator has previously taken were not suitable to adequately further process the unfused pages can hereby be output to the operator. In a third stage, an error message is generated and in particular transmitted to the data source, whereby the reprinting of the unfused page is started. In the course of this additional technique measures can automatically be taken: for example, a message can be output that informs the operator that the error message has been transmitted and the reprinting is to be expected. Furthermore in this stage an automatic page feed can be initiated by the printing apparatus. Over the entire process workflow an operator can thus receive suitable information, warnings and/or error messages that unfused pages are still located in the printing apparatus. Furthermore, the operator can be offered a selection of operating commands that are suitable to subsequently fuse the unfused pages. Furthermore, it can be checked whether an input operating command is suitable to fuse the unfused pages given corresponding continuation of the operation of the printing apparatus.

Via the output of the warning notification, after the print stop the operator in particular receives an immediate feedback that unfused pages are still present within the printing apparatus. Via the second warning notification and possible error messages additionally appearing in this context, the operator can be forced to make a decision as to whether the unfused pages are to be discarded or not. An accidental discard that would occur without knowledge of the operator can thereby be precluded. If, in spite of the notifications, warnings and possible error messages, the operator decides to discard the unfused pages, the error message is generated automatically so that the discarded pages can be reliably reprinted. By transferring the error message to other units of the printing system (for example to the data source), the discarding and possibly also detailed information across the system can be recorded, brought to the attention of additional persons (for example the originator of the print job) and be tracked, and additional measures can possibly be taken—for example, the print job including the unfused pages is completely reprinted on another, temporarily available printing apparatus.

The preferred embodiment is in particular based on the realization that warning notifications along at a display device of the printing apparatus are frequently not sufficient to make the operator sufficiently aware of the problem of unfused pages (and therefore the data loss) and to take corresponding measures. According to experience, operating instructions at apparatuses are frequently overlooked by the operator or intentionally ignored. In the preferred embodiment it is therefore in particular provided that the printing apparatus remains in the stopped operating state until a suitable operating command is input by the operator or—in the event that such a command is absent—the error message for the reprinting is automatically generated. As long as such a decision has not been made, it is automatically prevented that printed data or pages are lost. For example, it has proven to be advantageous that, if the operator must actively decide (for example by means of pressing a button on an operator input console) what should happen with the unfused pages, the operator's awareness of the problem of the unfused pages was markedly improved, and therefore print jobs were output in entirety with greater certainty. As long as a corresponding decision has not been made, the printing apparatus is kept in the stopped operating state in order to avoid data loss.

Furthermore, it has proven to be advantageous that the error message about unfused pages not only remains in the printing apparatus but also is transmitted to external apparatuses, in particular to the respective data source of the corresponding print job. A type of redundancy is hereby achieved via which the errors can also be recorded and processed in the external apparatus. It is thereby particularly advantageous if a reprinting of the unfused pages is automatically triggered in the data source.

The preferred embodiment can in particular be advantageously applied in printing systems in which the web-shaped recording medium is detected precisely to the page inside the apparatus by means of multiple sensors, wherein the sensors detect markings already pre-printed on the recording medium within the scope of the transfer printing and/or using transport holes in the recording medium and are therefore synchronized. In particular if the per page synchronization is lost (for example because the process must switch between two print jobs with different page lengths or the paper web is moved forward or backward via unsynchronized transport functions such as a manual feed), such states can arise in which, although it can be detected that unfused paper is in the printing apparatus, an automatically monitored additional movement and fixing is no longer possible.

The preferred embodiment is in particular advantageously applicable for printing apparatuses in which the web-shaped recording medium (in particular a paper web) travels a relatively long way between the transfer printing station and the fusing station. In high capacity digital printing systems, this distance can be one or even a few meters, for example one to five meters.

In an advantageous embodiment of the invention, the error message about the at least one unfused page is transferred to the data source. The data source then resends the data of the at least one unfused page to the printing apparatus for reprinting. A message is nevertheless not sent to the data set prematurely because the operator repeatedly receives the possibility—in particular in the course of the multistage warning instructions and error messages and—to directly solve the problem at the printing apparatus, i.e. to set the printing apparatus so that the unfused page is still fused.

The warning instruction can be reproduced graphically, optically, acoustically and/or via text at the display device. The display device can be a monitor, in particular a computer with corresponding input/output units and/or lights, loudspeakers and the like. The display device and an input device to input the operating commands can be integrated into the printing apparatus or also be arranged separate from the printing apparatus and merely be connected with this in terms of data. In particular a command via which the at least one unfused page is subsequently fused in the printing apparatus can be input as an operating command. For this it can in particular be provided that a transfer printing of subsequent pages is prevented and the recording medium is only additionally transported further until the determined unfused pages are fused. On the other hand, as of the belated fusing in the printing apparatus the regular printing operation of the same print job or a new print job can be continued with page precision.

Furthermore, it is in particular advantageous to automatically detect in the printing apparatus which pages of a print job that are to be printed are unfused. Furthermore, it is advantageous when the warning instruction and/or the error message contains information about all unfused pages, for example about the total number of unfused pages, or the information individually identifies the respective pages, for example using continuous page numbers.

In a further advantageous exemplary embodiment of the invention, the printing process within the printing apparatus is detected precisely to the page at least two process-determining locations, for example electronically at the output of the print image at a character generator; upon exposing the image at a photoelement; upon transfer-printing a developed image onto an intermediate carrier (for example a transfer belt) or onto the recording medium; upon fixing; and/or upon the finished printed and fused image leaving the printing apparatus. The detection of the printed pages can occur at least partially with optoelectronic sensors in that synchronization markings on the recording medium are regularly detected and monitored in its transport direction in the printing apparatus with a page monitoring device. Process-determining locations can, for example, be the location of the transfer-printing station, the location of the fusing station and/or the location of a discharging device for the recording medium web at the output of the printing apparatus. In particular markers that are individual to the page can be printed on the recording medium as synchronization markers in the transfer printing station.

For precise tracking of the pages within the printing apparatus it can furthermore be provided that the pages are identified and possibly subjected to a rastering process in a controller of the printing apparatus that receives the data from the data source; the respective pages are thereby registered inside the apparatus at the page monitoring device, and after the transfer printing process it is detected for the respective pages that the transfer printing has occurred, and furthermore when the respective page has gone through the fusing process is monitored. Furthermore, it can be detected when the corresponding page leaves the printing apparatus, and this page is then registered as having been printed to completion in the page monitoring device within the apparatus. Via such a page-precise tracking within the printing apparatus, on the one hand it can be automatically established whether unfused pages are still located in the printing apparatus given a stop-page of the printing process, and on the other hand it can be ensured that all pages are printed correctly or that a corresponding, page-precise error message and request for a reprinting of the incorrect pages occurs in the event of an error.

A concept according to the preferred embodiment can also be described as follows: in a high capacity printing system with a printing apparatus in which images made up of digital print data are transfer-printed per-page onto a web-shaped recording medium at a transfer printing point of a transfer printing station and the recording medium is transported from there over a transport distance to a fusing station, a method is provided for certain handling of unfused pages after a print stop. A multistage escalation-like process is thereby provided in which a warning message about the unfused pages is generated and output in an initial situation of the escalation process. It is then monitored whether and possibly which operating commands are input. In the event that the execution of the operating command in the printing apparatus would lead to the situation that the unfused pages would still be output, in a first escalation stage an error message internal to the printing apparatus is generated and the input of operating commands is again monitored. In the event that this operating command would likewise cause an output of the unfused pages, in a second escalation stage an error message is generated such that due to it a specific reprinting of the unfused pages can be initiated.

Additional advantages, effects and advantageous developments of the preferred embodiment proceed from the following exemplary embodiments described in the drawing figures. Identical system components are respectively provided with the same reference characters in different drawing figures.

A high capacity printing system 111 whose design substantially corresponds to a printing apparatus that is described in the disclosure document US 2006/0147232 A1 and in which the method according to the preferred embodiment can be advantageously realized is shown in FIG. 1. The printing apparatus 111 is subdivided into a printing group 110 and a fusing station 112 that respectively have independent housings 114, 116 that are connected with one another. A web 118 of continuous paper is directed through both housings 114, 116. A web retraction motor 122 that exerts a retention force on the web 118 with the aid of a roller pair is arranged in a web front-feed region 120 for the printing group 110. Furthermore, a web brake 124 is provided that smoothes the web 118 and likewise exerts a retention force on the web 118. The web brake 124 is, for example, realized by a felt that rests on the web 118. Another possibility is to use a negative pressure brake. The paper web is thereby charged with vacuum (i.e. suctioned) on the underside and the friction changes accordingly. A second sensor 126 that detects the real position of the page edge of the web 118 is arranged in the web front-feed region of the retraction device 120, more precisely just after the web brake 124 (as viewed in the normal transport direction).

The web 118 is supplied via a deflection roller 128 to a rotating frame 130 that serves as an adjustment element to adjust the position of the lateral edge of the web 118. The rotating frame 130 executes rotating movements around an axis perpendicular to the web 118 and thereby shifts the lateral edge in a direction perpendicular to the paper web of FIG. 1. A first sensor 132 that detects the real position of the lateral edge of the web 118 is arranged in the discharge region of the rotating frame 130. The web 118 is supplied via two additional deflection rollers 134, 136 to a web drive 138 that contains a roller pair. The web drive 138 moves the web 118 forward in the transport direction against the retention force of the web brake 124.

In the further course, an upper transfer printing station 140 and a lower transfer printing station 142 are arranged on both sides of the web 118. Both transfer printing stations 140, 142 print the top side and the underside of the web 118 with toner images simultaneously. The two transfer printing stations 140, 142 are substantially identical in design, which is why only the upper transfer printing station 140 is explained in detail in the following. The upper transfer printing station 140 comprises a character generator 144 that generates an electrostatic charge image on a photoconductor belt 146 corresponding to a print image to be printed. An upper developer station 148 inks the electrostatic charge image with toner material; the toner images are then transferred to a transfer belt 150. In the further course, the toner images located on the transfer belt 150 are then transferred at the transfer printing point 152 to the web 118; this means that toner images are simultaneously transfer-printed onto both sides of the paper web 118 by both transfer printing stations 140, 142 at the transfer printing point 152.

After the transfer printing point 152 (as viewed in the transport direction), a third sensor 154 is arranged that detects print markers on the web 118 that are either already pre-printed on the web 118 before this is introduced into the printing apparatus 111 or have been transfer-printed as toner images in the printing apparatus 111. The third sensor 154 is coupled in terms of control with a paper transport controller 215, 216 (FIG. 2) that controls the web drive 138 inside the apparatus. Furthermore, the signals of the third sensor 153 are used to detect the printed pages inside the printing apparatus and for a page tracking. For this, corresponding sensors are located at the input of the fusing station 112 and at a discharge device 164. Additional details of such sensors and drive synchronizations are described in, for example, U.S. Pat. No. 6,256,474 B1, the content of which is herewith again incorporated by reference at this point of the Specification.

The toner images that have not yet been fused on the web 118 are transported from the transfer printing point 152 over a transport region 153 (that exhibits a length a of, for instance, 2 meters) to a position 159 in the fixing station 112 in order to traverse the infrared fusing devices 156, 158 and be fused. They are subsequently transported past blowers 160, 162 that cool the web 118. A discharge device 164 with a discharge motor that acts on a rotating roller pair and conveys the web 118 out of the fixing station 112 is arranged in the output region 165 of the fusing station 112.

Figure 2:
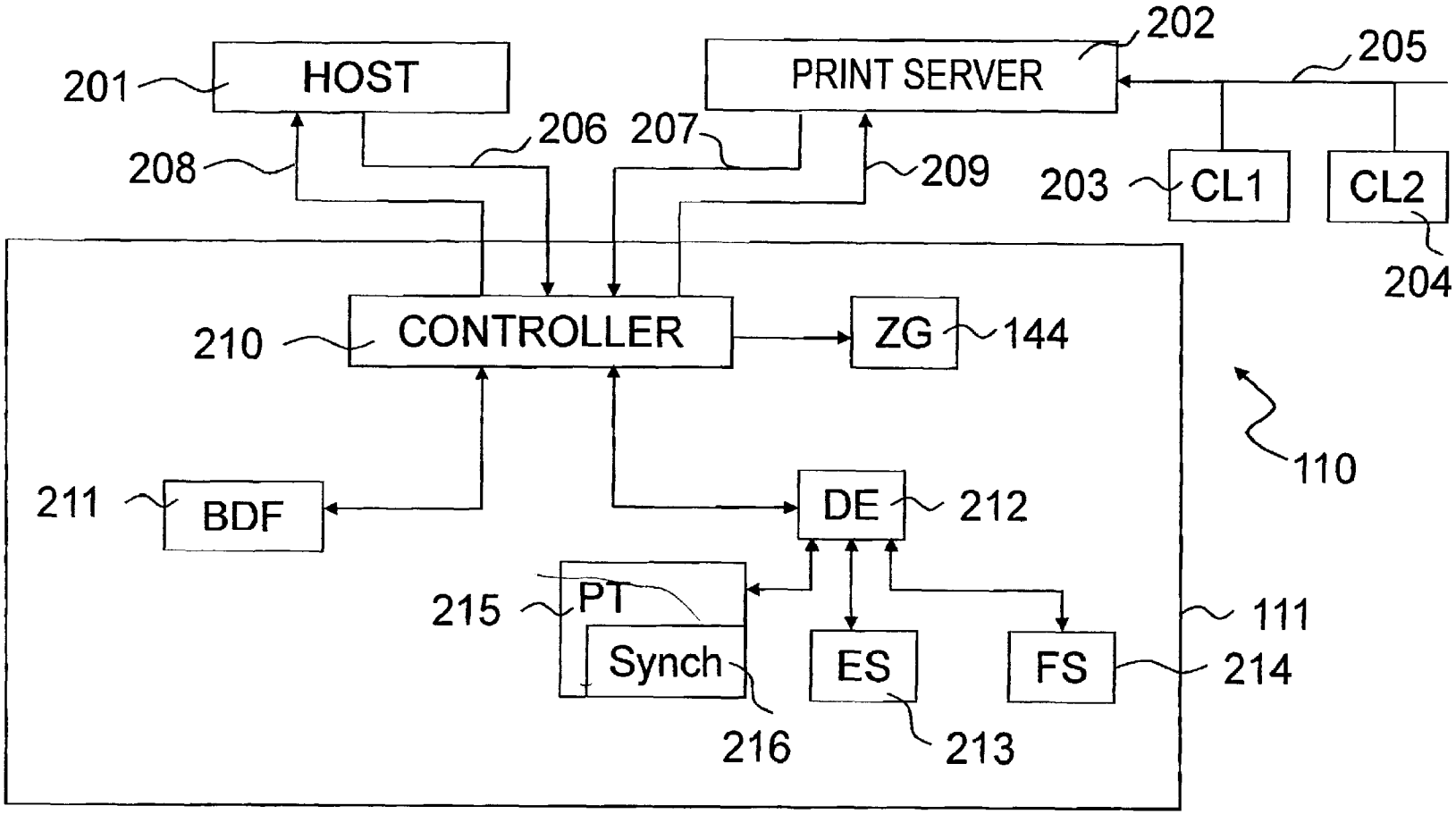
FIG. 2 shows control components of a high capacity printing system.

A printing system 100 in which two data sources (namely a host data source 201 and a print server 202) are connected to the printing apparatus 111 is shown in FIG. 2. The print server 202 can in turn receive print data from a first client 203 or a second client 204 via a network connection 205. The system can in particular correspond to the system shown in FIG. 1 in US 2004/0139115 A1 and contain additional components shown there. This publication is likewise herewith incorporated by reference at this point in the Specification.

The printing apparatus 111 has a controller 210 that can exchange data with the host computer 201 and possibly with the print server 202. Print data of print jobs can thereby be transferred to the controller 210 via the data paths 206, 207. Furthermore, feedback (for example the message about unfused pages and/or the instruction to initiate a reprinting of unfused pages) can be transferred from the controller 210 to the host computer 201 or print server 202 via the data paths 208, 209. For example, messages that specific pages have been correctly printed (i.e. are complete and fused) on the one hand and with an error message that the printing process of the job was terminated at a specific point (page) (hard error) on the other hand can thereby be transferred to the host computer 201 with regard to a print job. The host computer 201 can then independently determine or establish which pages of the print job are to be reprinted. It can thereby be provided that only the unfused pages that lead to the error message are reprinted, or also additional pages (for example an entire chapter of a book to be printed).

The controller 210 additionally contains known components for the interpretation of print data streams, for example parsers for the Intelligent Printer Data Stream (IPDS) or Printer Command Language (PCL) data streams. Furthermore, it contains components for rastering the print data, in particular a raster image processor (RIP) and an output unit that outputs the rastered data to the character generator 144. In the case of the electrophotographic printing apparatus 111 (FIG. 1), the character generator 144 can for example comprise a plurality of light emitting diodes with which the photoconductor belt 146 is exposed. The controller 210 is furthermore connected with a control panel unit 211 via which messages of the printing apparatus 110 can be output and operating commands can be input. The control panel 211 can in particular comprise an independent computer with screen and keyboard, or also with a touchscreen. Both the control panel 211 and the controller 210 do not necessarily have to be permanently integrated into the printing apparatus 111; rather, they can be designed as independent modules (computers) and merely be connected via a data connection with control components internal to the printer.

Printer-internal control components are connected via an apparatus controller 212 with the controller 210 respectively via bidirectional data lines or data bus systems over which all messages and control commands can be exchanged. Examples of apparatus-internal control components for the developer station 213, for the fusing station 214 and for the paper transport 215 are shown in FIG. 2. The paper transport controller 215 in particular has a synchronization unit 216 with which print markers on the recording medium web 118 can be detected and for page-apparatus line-precise synchronization of the transport of the paper web with which transfer-printing generated by the character generator 144 and the developer station 146. Furthermore, the page-precise monitoring of the printing process is possible via the controller 210 and the apparatus controller 212. For this a print page is registered by (and in particular in the controller 210) at a page monitoring unit realized in terms of software (for example in the controller 210 or in the apparatus controller 212) as soon as the page is output at the character generator 144. This can in particular occur after all microlines of a print page have been output. The pages are furthermore monitored by different sensors mounted at locations determining the printing process (for example the sensor 154 mounted in the region of the transfer printing point 152 in the region of the synchronization 216 or an additional sensor that is mounted at the output of the printing apparatus 111 in the region of the discharge device 164) and likewise communicated to the page monitoring unit. The correct execution of the print job is thus enabled per page, from the presentation of the page in the character generator up to the output of the fused page. If a print stop is arranged by the controller 210, the control panel 211 or the apparatus controller 212, the paper transport 215 stops the movement of the recording medium. Based on the page tracking in the controller 210 or in the apparatus controller 212 it can then be detected whether unfused pages are still located in the transport region 153 between the transfer printing point 152 and the output 165 of the fusing station 112 (i.e. the output of the printing apparatus 111). The warning that unfused pages are still located in the printing apparatus can then be generated in the apparatus controller 212 or in the controller 210 and be output to the control panel 211.

Figure 3:
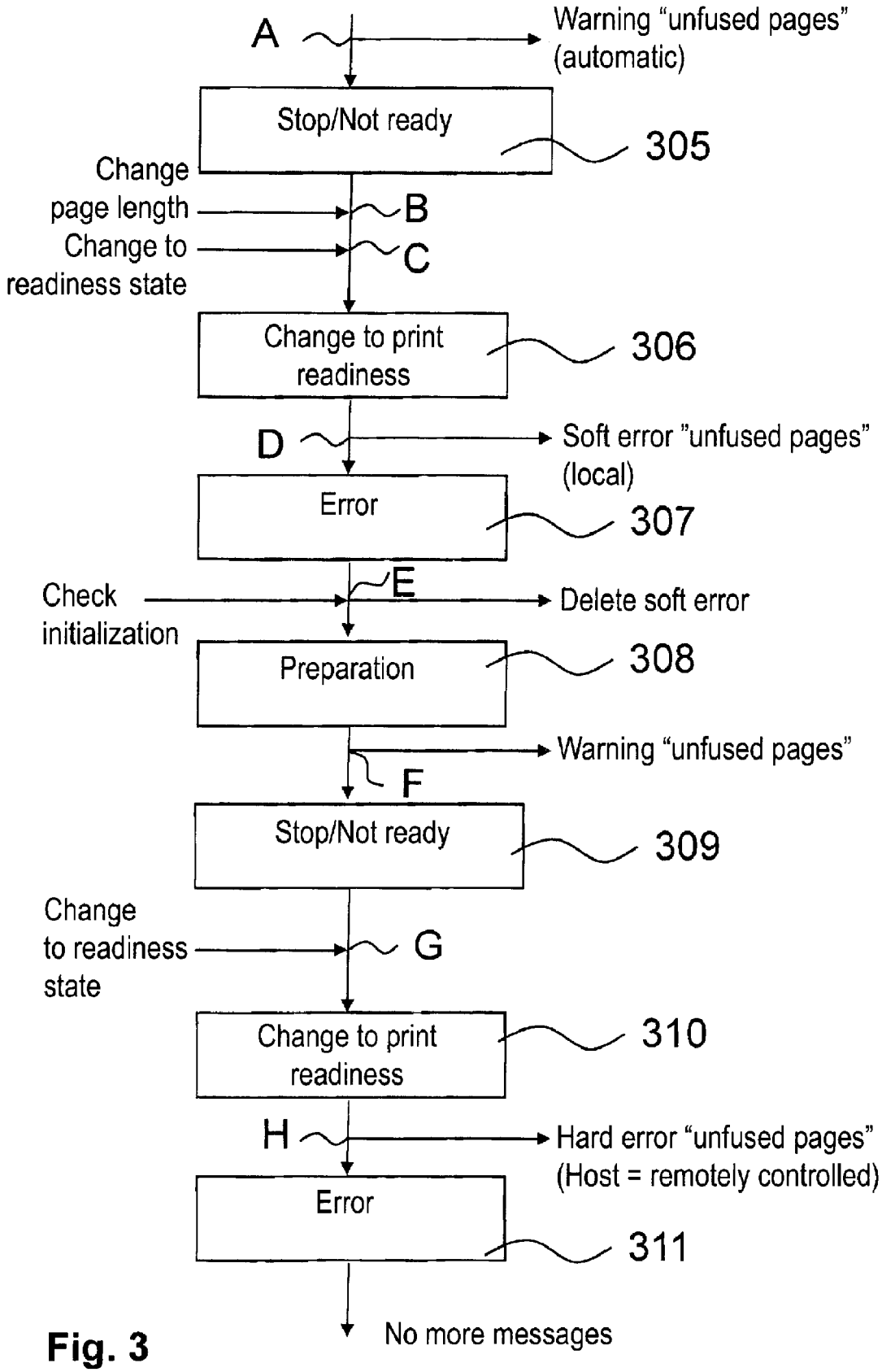
FIG. 3 illustrates a control process if unfused pages are detected.

The diagram of a workflow that occurs in cooperation between controller 210, control panel 211 and apparatus controller 212 when the respective operating commands are input by a user via the control panel 211 is shown in FIG. 3. Inputs that an operator makes via the control panel 211 are shown in the left region of FIG. 3; machine states that are generated by the apparatus controller 212 are shown in rectangles in the middle region; and warnings and automatic actions directly connected with them are shown in the right region. At the beginning a print stop at the printing apparatus is initiated via which the recording medium is halted, a further transfer printing is prevented, and the fixing station is deactivated. As described above, at the workflow point A it is automatically checked whether at least one transfer-printed but unfused page is still located in the printing apparatus. If this is the case, a warning message "unfused pages" is automatically generated and it is displayed on the control panel that at least one unfused page is still located in the printing apparatus. The printing apparatus initially remains in the stop state 305; however, the query occurs as to whether an operating command for the printing apparatus has been input. An operating command "page length change" that should change the page length of the pages to be printed is shown as an example at workflow point B in FIG. 3 and an operating command that should change the printing apparatus out of the stop state into a print readiness state is shown as an example at workflow point C. In the state 306 the apparatus controller automatically attempts to change into the print readiness state and queries whether operating commands have been input.

In the course of the attempt to change into the print readiness state it is checked whether the previously established unfused pages would be output unfused from the printing apparatus given execution of the operating command (here the command for print readiness and changing of the page length). This would be the case in the case shown in FIG. 3 because a resynchronization of the paper transport would be required in the course of changing over the page length, due to which pages without fusing would be output since the fixing controller cannot be set to specific page lengths in this state. Therefore the warning message "unfused pages" is re-output at the workflow point D. Additionally, at this decision point an apparatus-internal, local error message (what is known as a soft error message, soft error) is generated that indicates that an operating command was input given whose execution the unfused page would be output in the unfused state from the printing apparatus. The apparatus then changes into an error state 307. In this state the user can input a command for initialization check via which the local error message is erased (workflow point E) and via which the printing apparatus is set in a preparation state 308 in which it is checked whether all components of the printing apparatus are ready to print. In the course of this test it is established (workflow point F) that the page monitoring indicates as before that unfused pages are contained in the transport path of the recording medium. Therefore a corresponding warning about unfused pages is output and the apparatus is placed in the stop state (state 309). The same check as before then occurs between states 305 and 306, meaning that operating commands are queried (workflow point G) and it is checked whether given their execution the unfused pages would again be output from the printing apparatus. If, as shown, the operating command to achieve the print readiness state is input again, the printing apparatus in state 310 (as already occurred in state 306) then attempts to achieve the print readiness state. If it is established that unfused pages would be output, an additional, hard error message about unfused pages is automatically generated at workflow point H, via which a reprinting of the unfused pages is initiated. This error message is not only handled internally by the apparatus but is also communicated externally to a data source, for example the host computer 201 or the print server 202 via one of the paths 208, 209. The printing apparatus 111 alone can then no longer independently correct the error of the unfused pages; the error message is therefore called a hard error. The reprinting of the unfused pages can only be triggered by the external data source (host or print server), i.e. be remotely controlled, wherein the print data of the unfused pages are retransmitted from the corresponding data source to the printing apparatus 111 or its controller 210. After the generation of the additional error message, the printing apparatus 111 automatically transitions again into the error state (state 311). Within the printing apparatus, all warnings and error messages are then deleted and no further message is output any more. The printing apparatus 111 can then be used immediately to continue printing processes or to start new print jobs Unused pages can be manually removed from the printing apparatus 111 by the operator or the recording medium 118 can be moved via manual feed at the printing apparatus 111. The unfused pages to be discarded are reprinted in a fully automatic or at least partially automatic manner such that the corresponding data source (host, print server) automatically feeds the data to the printing apparatus or character generator.

Figure 4:
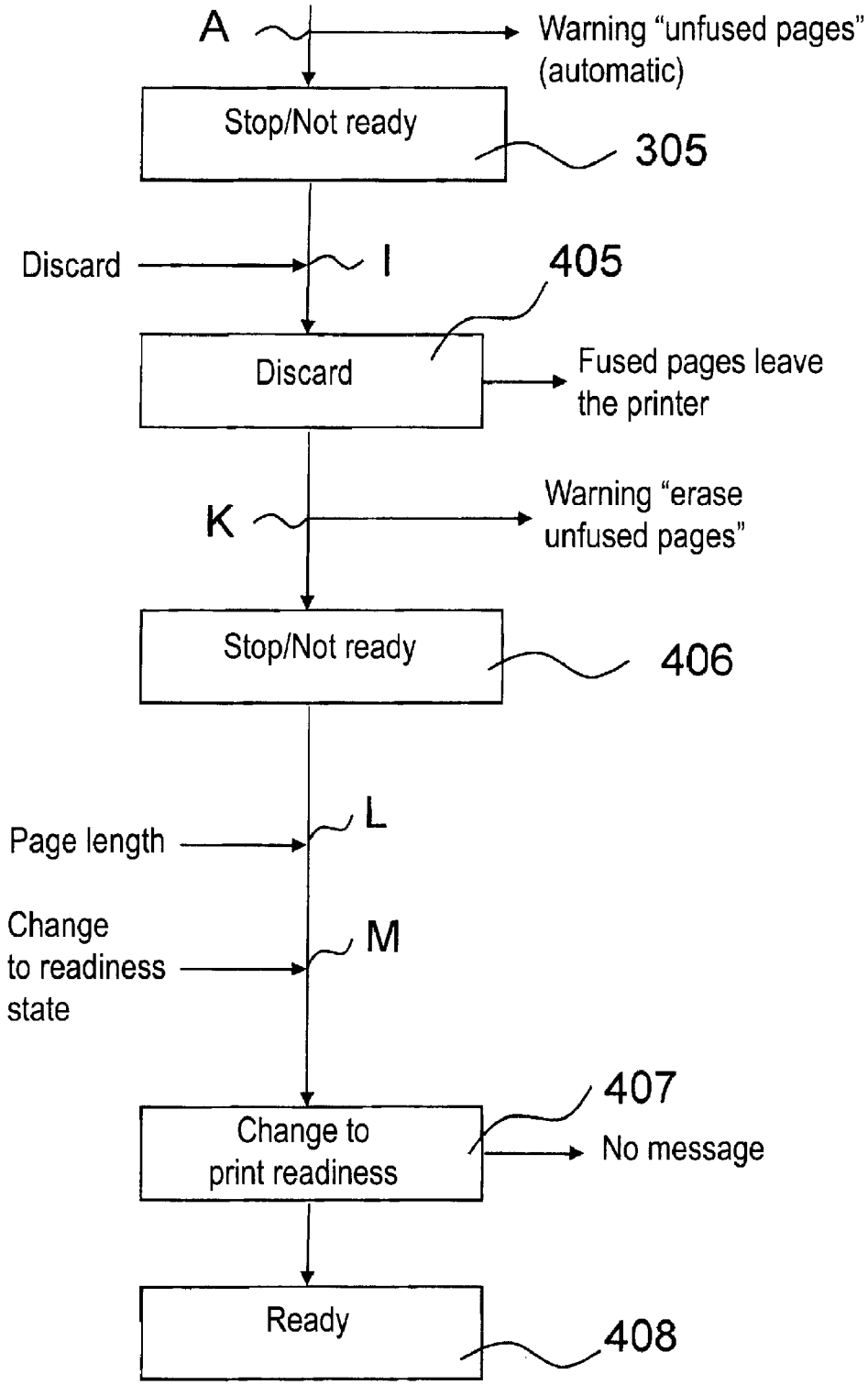
FIG. 4 illustrates an additional control process if unfused pages are detected.

In the workflow diagram shown in FIG. 4, as in the diagram in FIG. 3, it is checked automatically at the workflow point A whether at least one transfer-printed but unfused page is still located in the printing apparatus. This is also the case in the example shown here, which is why the warning "Unfused Pages" is likewise automatically output and the apparatus switches into the stop state 305. What is different than in the example shown in FIG. 3—in which the two user inputs "change page length" and "switch to print readiness state" at the points B, C were not suitable to subsequently fix the unfused pages—is that, in the example of FIG. 4, the operating command "discard" occurs at the workflow point I, via which the paper web is transported forward and therefore the printed pages are transported out of the printing apparatus, wherein no transfer printing occurs but the fusing station is activated. The printing apparatus thus switches into the discard operating state 405 and the unfused pages are fused in the fixing station and leave the printer completely printed and fused. The warning "unfused pages" is automatically erased inside the apparatus at the workflow point K and the printing apparatus is subsequently placed in the stop state 406. Now the input of a new page length by the operator occurs at the workflow point L and the operating command "switch to readiness state" occurs at the workflow point M in order to place the printing apparatus in readiness to print a new print job with changed page length. Without an additional message, the printing apparatus then accordingly automatically arrives from the state 407 into the readiness state 408.

The operating commands explained in FIGS. 3 and 4 are merely examples. On the one hand, there are a plurality of possible operating commands that can lead to the output of unfused pages, and on the other hand a plurality of those operating commands with which it is ensured that the pages are output in the fused state. These operating commands or command sequences and their respective property related to the output of unfused pages (ok or not ok) can be stored in the overall controller of the printing apparatus (controller, control panel and/or apparatus controller) so that the described workflows can be implemented safely.

Although the preferred embodiment was described in the exemplary embodiment using an electrophotographic high capacity printing system, it can also be used in other types of printing systems. For example, it can be applied in high capacity inkjet printing systems that have a fusing or drying unit for the imaging ink, for example UV lamps to cure UV-curable ink or heating or ventilator elements to dry water-based ink. In particular if the recording medium is web-shaped so that a greater amount of the web is located within the printing apparatus all at once, the advantage of the preferred embodiment—according to which it can be ensured that the images output at the printing apparatus are properly, completely fused—especially comes to bear.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A method to print a web-shaped recording medium in a digital high capacity printing system that comprises at least one digital data source and a printing apparatus connected to said at least one digital data source, comprising the steps of:

transferring print data of a print job from the at least one digital data source to the printing apparatus;

moving the recording medium to a transfer printing point of a transfer printing station of the printing apparatus, and there print images corresponding to the print data are transfer-printed per page onto the recording medium;

transporting the recording medium over a transport area from the transfer printing point to a fusing station of the printing apparatus in which the print images are subjected to a fusing process to fuse the images on the recording medium;

initiating a print stop at the printing apparatus whereby the recording medium is halted, a further transfer printing is prevented, and the fusing station is deactivated; and automatically checking whether at least one transfer-printed but unfused page is still located in the printing apparatus, wherein following actions are executed in the printing apparatus if at least one unfused page is still located in said printing apparatus automatically generating a warning notification indicating presence of said at least one unfused page and displaying the warning notification on a display device of the printing apparatus if said at least one unfused page is located in the printing apparatus, querying as to whether an operating command for the printing apparatus has been input, in the event that an operating command has been input, in a first check checking whether the at least one unfused page would also be output unfused from the printing apparatus upon execution of said operating command, if the first check yields a no, the operating command is executed, if the first check yields a yes, the print stop is automatically maintained, an apparatus-internal error state is generated, and a query is executed as to whether an additional operating command for the printing apparatus has been input, and it is also inspected in a second check as to whether the at least one unfused page would be output unfused from the printing apparatus upon execution of said additional operating command, if the second check yields a no, the additional operating command is executed, and if the second check yields a yes, an error message is automatically generated that indicates that the at least one unfused page is to be reprinted.

2. The method according to claim 1 wherein in the course of the apparatus-internal error state generated after the first check, the warning notification is displayed again at the display device and another or an additional notification is at least one of displayed and output.

3. The method according to claim 1 wherein the error message is transmitted to the data source and, by means of the error message, the data source is prompted to re-transfer the data of the at least one unfused page to the printing apparatus.

4. The method according to claim 1 wherein at least one page range in which the unfused page is located is identified in the print data and the unfused page is reprinted using the error message.

5. The method according to claim 1 wherein the warning notification is reproduced at least one of graphically, optically, acoustically, and via text at the display device.

6. The method according to claim 1 wherein a command via which the at least one unfused page is still belatedly fused is input as an operating command.

7. The method according to claim 6 wherein a transport movement of the recording medium is released without a transfer printing for belated fixing in the printing apparatus, and wherein the fusing station is set into operation at least during the transport of the recording medium.

8. The method according to claim 6, wherein regular print operation is continued to a page for belated fusing in the printing apparatus.

9. The method according to claim 1 wherein to detect which pages of a print job that are to be printed are unfused, the print pages are detected regularly by at least two locations of the printing apparatus determining the printing process and the detected page information are processed in a controller.

10. The method according to claim 1 wherein synchronization markers on the recording medium are detected and monitored precisely to the page regularly at process-determining locations in the transport direction of said recording medium in the printing apparatus with a synchronous monitoring device.

11. The method according to claim 10 wherein markers individual to the page are printed on the recording medium in the transfer printing station as synchronization markers.

12. The method according to claim 1 wherein which pages of a print job to be printed are unfused is automatically detected in the printing apparatus, and at least one of the warning instruction and the error message contains information about all unfused pages.

13. A printing system, comprising:

a data source;

a printing apparatus having a controller, a transfer printing station to transfer-print print images on a web-shaped recording medium, and a transport device to transport the recording medium;

said transport device comprising a web drive that transports the recording medium after the transfer-printing from print images to a fusing station that fuses the print images on the recording medium; and the printing apparatus comprising a display and operating device connected with said controller which perform the steps of transferring print data of a print job from the data source to the printing apparatus, moving the recording medium to a transfer printing point of a transfer printing station of the printing apparatus, and there print images corresponding to the print data are transfer-printed per page onto the recording medium, transporting the recording medium over a transport area from the transfer printing point to a fusing station of the printing apparatus in which the print images are subjected to a fusing process to fuse the images on the recording medium, initiating a print stop at the printing apparatus whereby the recording medium is halted, a further transfer printing is prevented and the fusing station is deactivated, automatically checking whether at least one transfer-printed but unfused page is still located in the printing apparatus, and if so, the following actions are executed automatically generating a warning notification indicating presence of said at least one infused page and displaying the warning notification on a display device of the printing apparatus if said at least one unfused page is located in the printing apparatus, querying as to whether an operating command for the printing apparatus has been input, in the event that an operating command has been input, in a first check checking whether the at least one unfused page would also be output unfused from the printing apparatus upon execution of said operating command, if the first check yields a no, the operating command is executed, if the first check yields a yes, the print stop is automatically maintained, an apparatus-internal error state is generated, and a query is executed as to whether an additional operating command for the printing apparatus has been input, and it is also inspected in a second check as to whether the at least one unfused page would be output unfused from the printing apparatus upon execution of said additional operating command, if the second check yields a no, the additional operating command is executed, and if the second check yields a yes, an error message is automatically generated that indicates that the at least one unfused page is to be reprinted.

14. A method to print a web-shaped recording medium in a digital printing system that comprises a printing apparatus, comprising the steps of:

providing print data of a print job in the printing apparatus;

moving the recording medium to a transfer printing station of the printing apparatus, and there print images corresponding to the print data are transfer-printed per page onto the recording medium;

transporting the recording medium from the transfer printing station to a fusing station;

initiating a print stop at the printing apparatus whereby the recording medium is halted, a further transfer printing is prevented, and the fusing station is deactivated; and automatically checking whether at least one transfer-printed but unfused page is still located in the printing apparatus, and if yes the following actions are executed automatically generating a warning notification indicating presence of said at least one unfixed page and displaying the warning notification on a display device of the printing apparatus if said at least one unfused page is located in the printing apparatus, querying as to whether an operating command for the printing apparatus has been input, in the event that an operating command has been input, in a first check checking whether the at least one unfused page would also be output unfused from the printing apparatus upon execution of said operating command, if the first check yields a no, the operating command is executed, if the first check yields a yes, the print stop is automatically maintained, and a query is executed as to whether an additional operating command for the printing apparatus has been input, and it is also inspected in a second check as to whether the at least one unfused page would be output unfused from the printing apparatus upon execution of said additional operating command, if the second check yields a no, the additional operating command is executed, if the second check yields a yes, an error message is automatically generated that indicates that the at least one unfused page is to be reprinted, and automatically reprinting the at least one unfused page.

* * * * *